US009381480B2

(12) United States Patent
Kang

(10) Patent No.: US 9,381,480 B2
(45) Date of Patent: Jul. 5, 2016

(54) CONTAINER FOR MIXING TWO DIFFERENT TYPES OF SOLUTIONS

(71) Applicant: HANA CO., LTD., Hwaseong-si (KR)

(72) Inventor: Sungil Kang, Hwaseong-Si (KR)

(73) Assignee: HANA CO., LTD., Hwaseong-si (KR)

( * ) Notice: Subject to any disclaimer, the term of this patent is extended or adjusted under 35 U.S.C. 154(b) by 35 days.

(21) Appl. No.: 14/251,525

(22) Filed: Apr. 11, 2014

(65) Prior Publication Data

US 2014/0313850 A1 Oct. 23, 2014

(30) Foreign Application Priority Data

Apr. 17, 2013 (KR) ..... 20-2013-0002967 U

(51) Int. Cl.
*B01F 5/06* (2006.01)
*B65D 25/08* (2006.01)
*B01F 15/02* (2006.01)

(52) U.S. Cl.
CPC ..... *B01F 15/0215* (2013.01); *B01F 15/0224* (2013.01); *B01F 15/0237* (2013.01)

(58) Field of Classification Search
CPC ..... B01F 13/002; B01F 7/00591; B01F 15/0215; B01F 15/0224; B01F 15/0237
USPC ..... 366/189, 190, 130, 176.3; 206/219, 206/221, 222; 417/202; 222/321.7
See application file for complete search history.

(56) References Cited

U.S. PATENT DOCUMENTS 5,306,125 A * 4/1994 Weag ..... B05B 11/0027 222/207
6,149,034 A * 11/2000 Amberg ..... D06F 39/022 222/152

* cited by examiner

*Primary Examiner* — Tony G Soohoo
*Assistant Examiner* — Anshu Bhatia

(57) ABSTRACT

Disclosed is a container including a temporary coupling member for pouring two different types of solutions into separated chambers and for separating the chambers from each other and for driving a supporting rotator to release the temporary coupling member so as to mix the two different types of solution. The container includes rotating pushing unit rotating; cylindrical lower support inserted into rotating pushing unit; liquid accommodating upper support inserted into lower support; vertical pushing unit installed in lower support and rotating pushing unit; opening device including opening disc, supporting unit, supporting unit, and bottom holes and lateral holes; elastic spring installed between lower support and vertical pushing unit and rotating the rotating pushing unit; pumping unit installed on lower support and accommodating liquid; and press button installed on pumping unit to operate pumping unit to discharge mixed liquid in pumping unit out.

6 Claims, 10 Drawing Sheets

CONTAINER FOR MIXING TWO DIFFERENT TYPES OF SOLUTIONS

CROSS REFERENCE TO RELATED APPLICATION

This application claims foreign priority benefits of Korea Patent Application No. 20-2013-0002967, filed on Apr. 17, 2013, which is incorporated by reference in its entirety into this application.

BACKGROUND OF THE INVENTION

1. Field of the Invention

The present invention relates to a container in which two different types of solutions are mixed, and more particularly to a container including a temporary coupling member for pouring two different types of solutions into separated chambers and for separating the chambers from each other and for driving a supporting rotator to release the temporary coupling member so as to mix the two different types of solution.

2. Description of the Prior Art

In general, some different chemicals selected from a group of same-based cosmetic materials and medicines are mixed so that novel cosmetics or medicines may be obtained. For example, colorant used in dying, oxidizing agent, and liquid or powder materials for make-up.

However, although the medicines and agents are used to exhibit novel property, the medicines and agents should be manufactured and accommodated in separated containers respectively for sale because of chemical change and difficult for long-term custody due to different components when mixture of two different medicines or agents is accommodated in a single container. Moreover, a user should buy these containers separately and mix these medicines or agents in a single container. Thus, it is inconvenient to manufacture, sale, and buy. However, dust in the air may be mixed with the medicines or agents when the solutions are mixed within the container and due to this the mixture may be changed by chemical reactions. In addition, since medicines, liquid cosmetics, and powder of different properties are accommodated in separated containers respectively, it is inconvenient to use and a lot of medicines and agents is wasted.

In view of the above-mentioned problems, new containers for accommodating two different types of medicines or agents into a single container are developing. For example, Korean Utility Model No. 305757 discloses a container for accommodating two different types of medicines or agents in a single container in a separated state such that medicine or agent accommodated in an upper container is mixed with the other medicine or agent accommodated in a lower container by breaking a shield plate of the upper container. This container will be briefly described with reference to FIGS. 1 and 2.

Referring to FIG. 1, a usual discharging device (without a reference number) is installed at the upper side of an upper container 10 and the lower side of the upper container is open such that a lower container 30 may be connected thereto. A shield member 20 having a shield plate 21 is installed between the upper container 10 and the lower container 30. The lower container 30 includes saw-shaped cutting blades 31 to cut an edge of the shield plate of the shield member 20.

Thus, when a rotation cap 30 is rotated, guide protrusions 32 and 32*a* provided at both lower sides of the lower container 30 are guided within guide holes 22 of the shield member 20 and ascend without rotation. Since the ascending lower container 30 includes the saw-shaped cutting blades 31 formed on the upper side thereof, the saw-shaped cutting blades 31 are sequentially in contact with the edge of the shield plate 21 of the shield plate 20 to cut the shield plate 21 from the shied member 20.

The cut shield plate 21, as illustrated in FIG. 2, is inclined by a partition 33 provided at a side of an accommodating chamber of the lower container 30 and first medicine 1 and second medicine 2 accommodated in the upper container 10 and the lower container 30 separately are mixed, then a user agitates the mixture to use.

Thus, since the container as illustrated in FIGS. 1 and 2 forms a single body, it is convenient to accommodate medicines and agents and to use. Moreover, the medicines and agents can be mixed not in separated containers but in a single body so that the medicines and the mixture can be prevented from being changed due to foreign material.

However, the existing container is designed such that the saw-shaped cutting blades 31 of the lower container 30 penetrate the bottom side of the shield plate 21 of the shield member 20 toward the upper side. Since the containers and the blades are made of identical material, the saw-shaped cutting blades 31 may be easily broken and only a part of the bottom of the shield plate is cut so that only some of the medicine or agent accommodated in the lower container 30 is mixed with the medicine or agent of the upper container 10 when a user shakes the container. Thus, a complete mixture cannot be obtained. In addition, even when the shield plate 21 is open as illustrated in FIG. 2, the separated shield plate 21 floats freely within the container and may block a discharging tube of the discharging device. Due to these problems, the existing container is not commercialized yet.

SUMMARY OF THE INVENTION

The present invention has been made in an effort to solve the above-described problems, and it is an object of the present invention to provide a mixing container for accommodating a first liquid and a second liquid by separating the same with an opening device provided in a single body and including a rotating pushing member, an elastic spring, and an opening device to open the opening device with the rotating pushing member and to mix the first liquid with the second liquid by the action of the elastic spring.

In accordance with an aspect of the present invention, there is provided a container for mixing two different types of liquids including: a rotating pushing unit rotating when griped by fingers and having a male screw formed at the center thereof; a cylindrical lower support inserted into the rotating pushing unit; a liquid accommodating upper support inserted into the lower support and having an opened lower side and a flange formed at the upper inner side; a vertical pushing unit installed in the lower support and the rotating pushing unit and having a cylindrical shape with a closed upper side and a cylindrical female screw formed at the center thereof and engaged with the male screw of the rotating pushing unit such that the male screw is engaged with female threads of the cylindrical female screw to be lifted up when the rotating pushing unit rotates clockwise; an opening device including an opening disc, a supporting unit, a supporting unit seated on the vertical pushing unit, and bottom holes and lateral holes formed in the supporting unit, the opening disc being seated on a circular flange of the liquid accommodating upper support; an elastic spring installed between the lower support and the vertical pushing unit and rotating the rotating pushing unit to ascend and applying an elastic force to the vertical pushing unit up to the liquid accommodating upper support when the opening device 50 is released such that a liquid accommodated in the liquid accommodating upper support is discharge out to the upper side and is mixed with another liquid in the container; a pumping unit installed on the lower support and accommodating a liquid to pump the mixed liquid out when the liquid accommodated in the liquid accommodating upper support is mixed; and a press button installed on the pumping unit to operate the pumping unit to discharge the mixed liquid in the pumping unit out.

The lower support includes first saw teeth formed at the upper side and the pumping unit includes second saw teeth corresponding to the first saw teeth to be engaged with each other.

The rotating pushing unit comprises a stopper formed at both bottom sides to determine rotation and stopping, and the lower support comprises a temporary stopper moving the stopper of the rotating pushing unit in a direction and an oblique tension formed at a position spaced apart from the temporary stopper.

The lower support is formed with coupling recesses at the lower side the liquid accommodating upper support is formed with a plurality of coupling protrusions at the lower outer side thereof to correspond to the coupling recesses such that the coupling protrusions are engaged with the coupling recesses of the lower support.

The lower support is formed with a plurality of protrusions therein and the vertical pushing unit is formed with a plurality of guide protrusions corresponding to the protrusions of the lower support such that the guide protrusions slide on the protrusions of the lower support to be lifted up.

The pumping unit includes: a pumping cylinder; a pumping piston installed on the pumping cylinder to move a cosmetic liquid accommodated in a case due to the vertical movement to a chamber of the pumping cylinder to discharge the cosmetic liquid out; a sealing member installed on the inner circumference of the pumping cylinder and moved by the vertical movement of the pumping piston to close the inside of the pumping cylinder and secure a passage such that the liquid solution in the cylinder is discharged out; and a check valve installed at the inner lower side of the pumping cylinder to suction the liquid solutions accommodated in the case into a pumping guide tube and to guide the liquid solutions accommodated in the pumping guide tube to be discharged out without retreat of the liquid cosmetics back into the case.

As described above, according to the mixing container of the present invention, the mixing container accommodates a first liquid and a second liquid by separating the same with an opening device provided in a single body and includes a rotating pushing member, an elastic spring, and an opening device to open the opening device with the rotating pushing member and to mix the first liquid with the second liquid by the action of the elastic spring.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, exemplary embodiments of the present invention will be described with reference to the accompanying drawings. However, the drawings and a description thereof correspond to the exemplary embodiments among various methods for effectively explaining the features of the present invention, and the present invention is not limited by the drawings and the description thereof.

Further, in the following description of the present invention, a detailed description of known functions and configurations incorporated herein will be omitted when it may make the subject matter of the present invention rather unclear. The following terms are those defined, considering the functions of the present invention, and may be changed according to the intentions of the user or the manager or the customs. Therefore, the definitions of the terms should be made based on the contents of the specification.

Functional elements already provided in a system or generally provided in the art to which the present invention pertains can be omitted from the exemplary embodiments of the present invention to effectively explain the the technical elements of the present invention. Thus, functional elements that should be additionally provided for the present invention will be mainly described.

Among functions of elements that are not illustrated but omitted, the functions of conventional elements can be easily understood by those skilled in the art to which the present invention pertains, and relationships between the omitted elements and the elements added for the present invention will be clearly understood.

In the description of the embodiment of the present invention, terms will be properly modified to effectively explain the technical features of the present invention so that those skilled in the art to which the present invention pertains can clearly understand the present invention, but the present invention is not limited thereto.

As a result, the technical spirit of the present invention is determined by the claims, and the embodiments of the present invention are provided to merely effectively explain the technical spirit of the present invention to those skilled in the art to which the present invention pertains.

Figure 1:
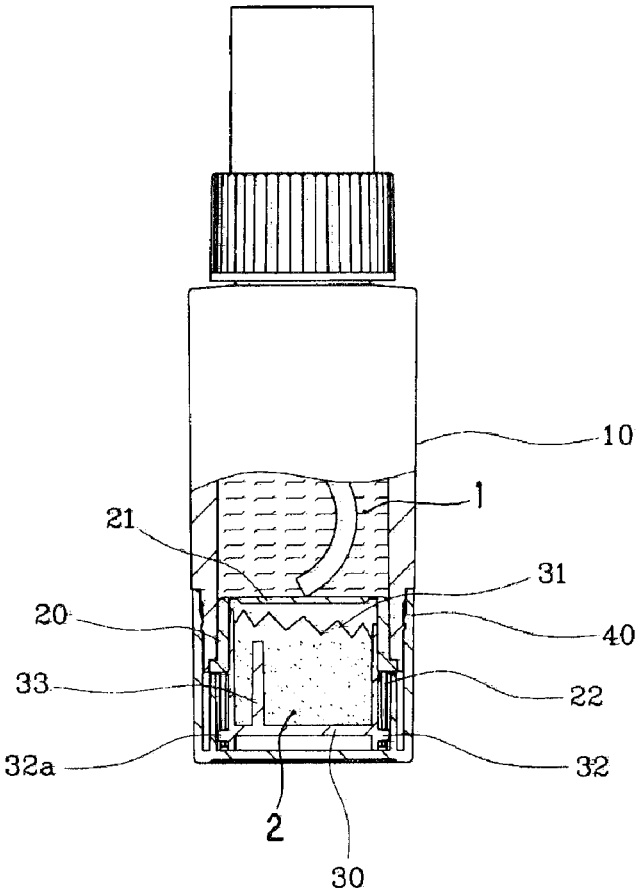
FIG. 1 PRIOR ART
FIGS. 1 and 2 are schematic views illustrating an existing mixing container for accommodating two different types of solutions.
Figure 2:
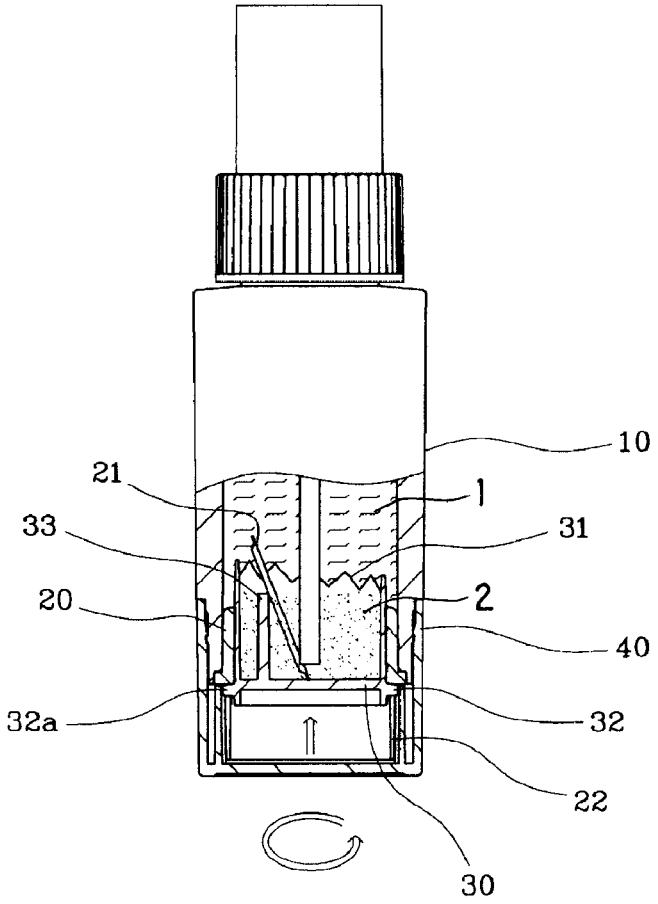
FIG. 2 PRIOR ART
Figure 3:
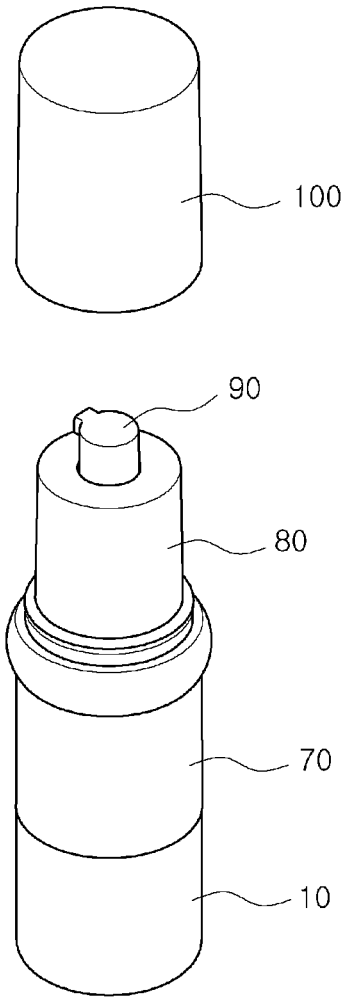
FIG. 3 is a perspective view illustrating a mixing container for accommodating two different types of solution according to an embodiment of the present invention.

FIG. 3 is a perspective view illustrating a mixing container for accommodating two different types of solution according to an embodiment of the present invention.

Figure 4:
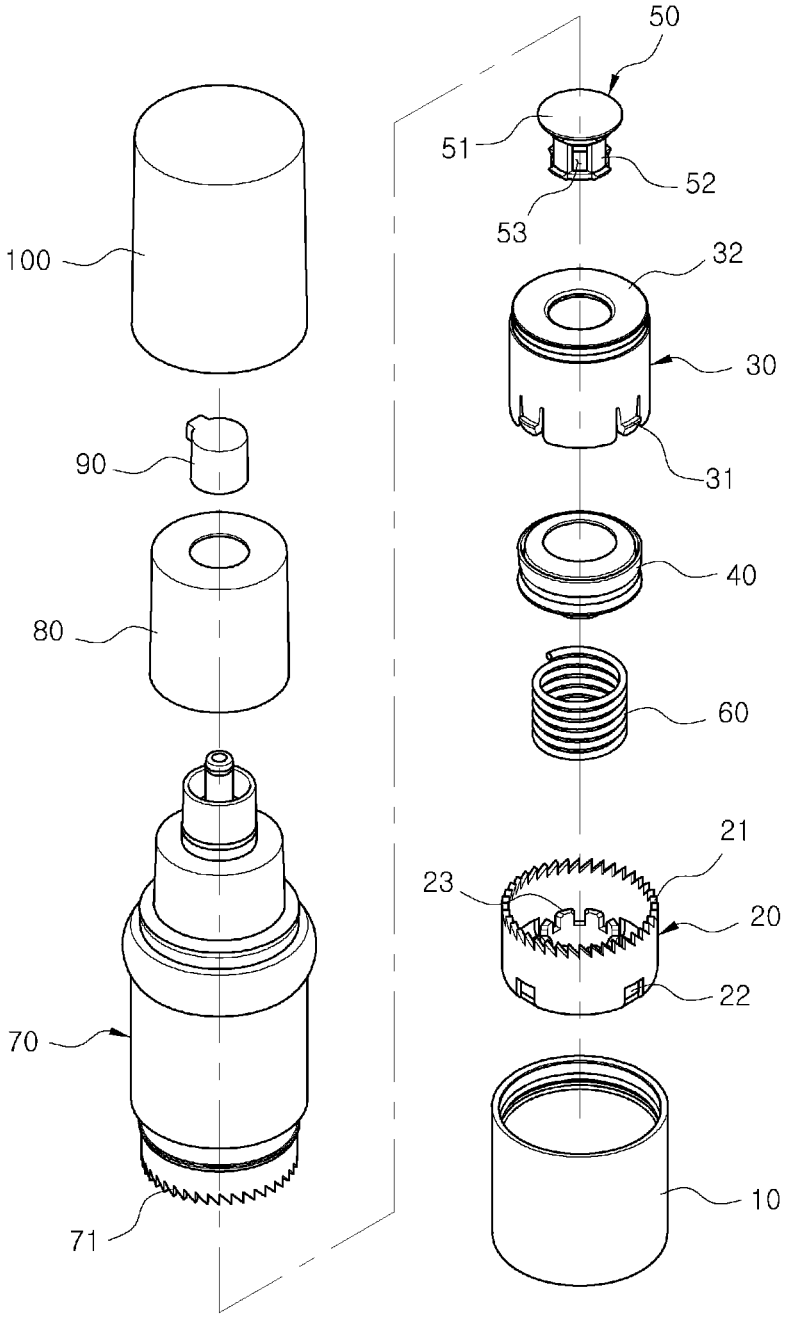
FIG. 4 is an exploded perspective view illustrating the mixing container according to an embodiment of the present invention.

FIG. 4 is an exploded perspective view illustrating the mixing container according to an embodiment of the present invention.

Figure 5:
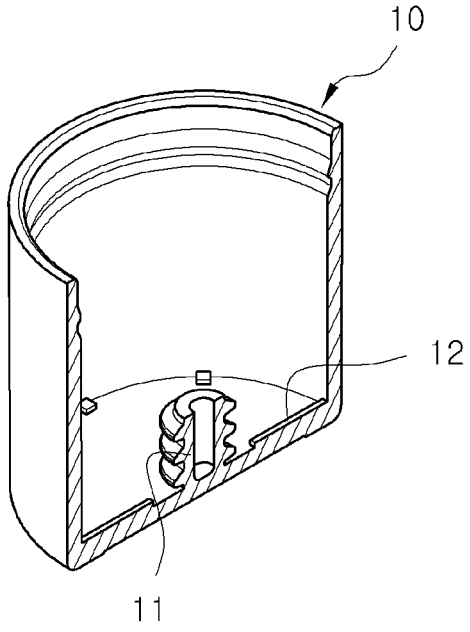
FIG. 5 is a sectional perspective view illustrating a rotating pushing member employed in the mixing container according to an embodiment of the present invention.

FIG. 5 is a sectional perspective view illustrating a rotating pushing member employed in the mixing container according to an embodiment of the present invention.

Figure 6:
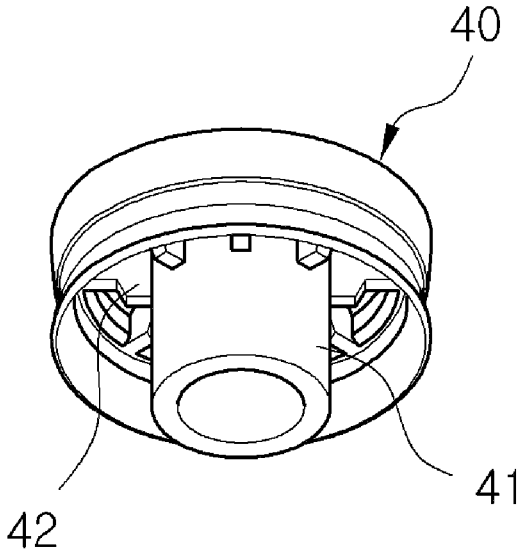
FIG. 6 is a perspective view illustrating a vertical pushing member employed in the mixing container according to an embodiment of the present invention.

FIG. 6 is a perspective view illustrating a vertical pushing member employed in the mixing container according to an embodiment of the present invention.

Figure 7:
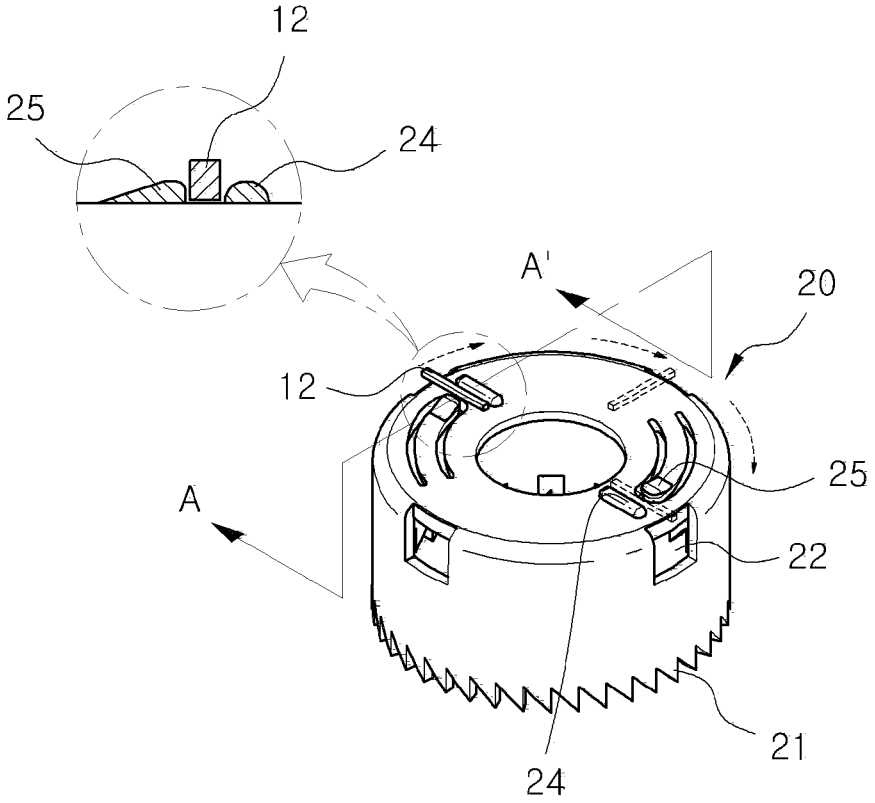
FIG. 7 shows a perspective view of a lower support and a rotating pushing member which are employed in the mixing container according to an embodiment of the present invention.

FIG. 7 shows a perspective view of a lower support and a rotating pushing member which are employed in the mixing container according to an embodiment of the present invention.

Figure 8:
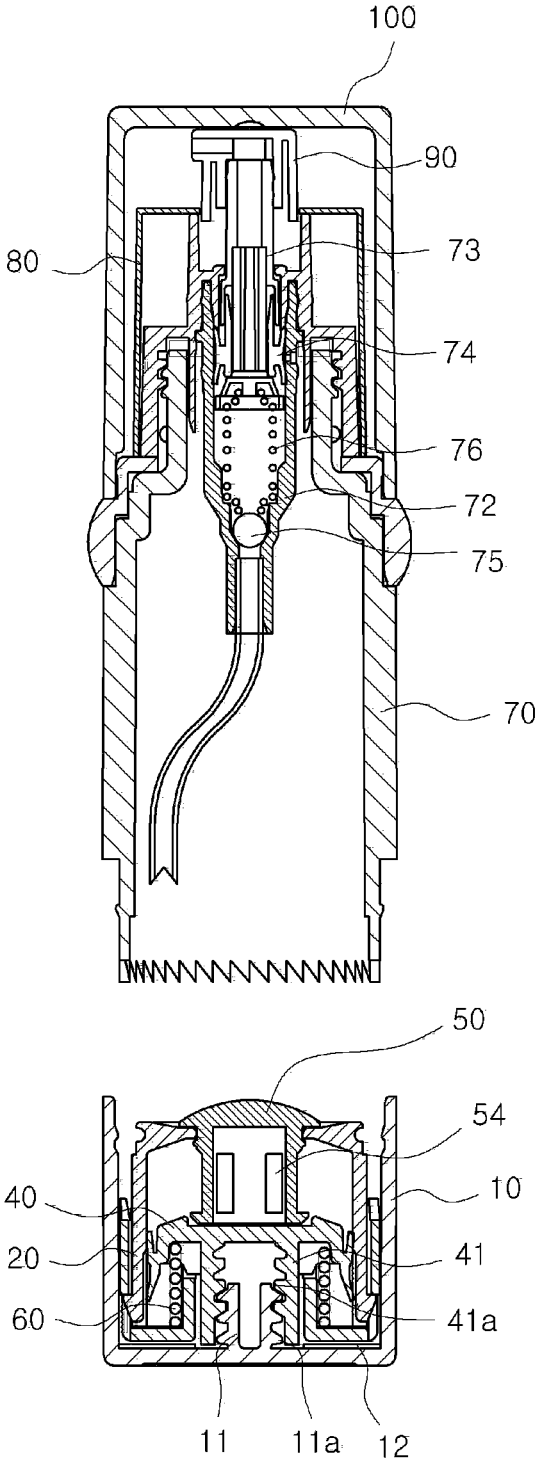
FIG. 8 is a sectional view illustrating a pre-assembled state of the mixing container according to an embodiment of the present invention.

FIG. 8 is a sectional view illustrating a pre-assembled state of the mixing container according to an embodiment of the present invention.

Figure 9:
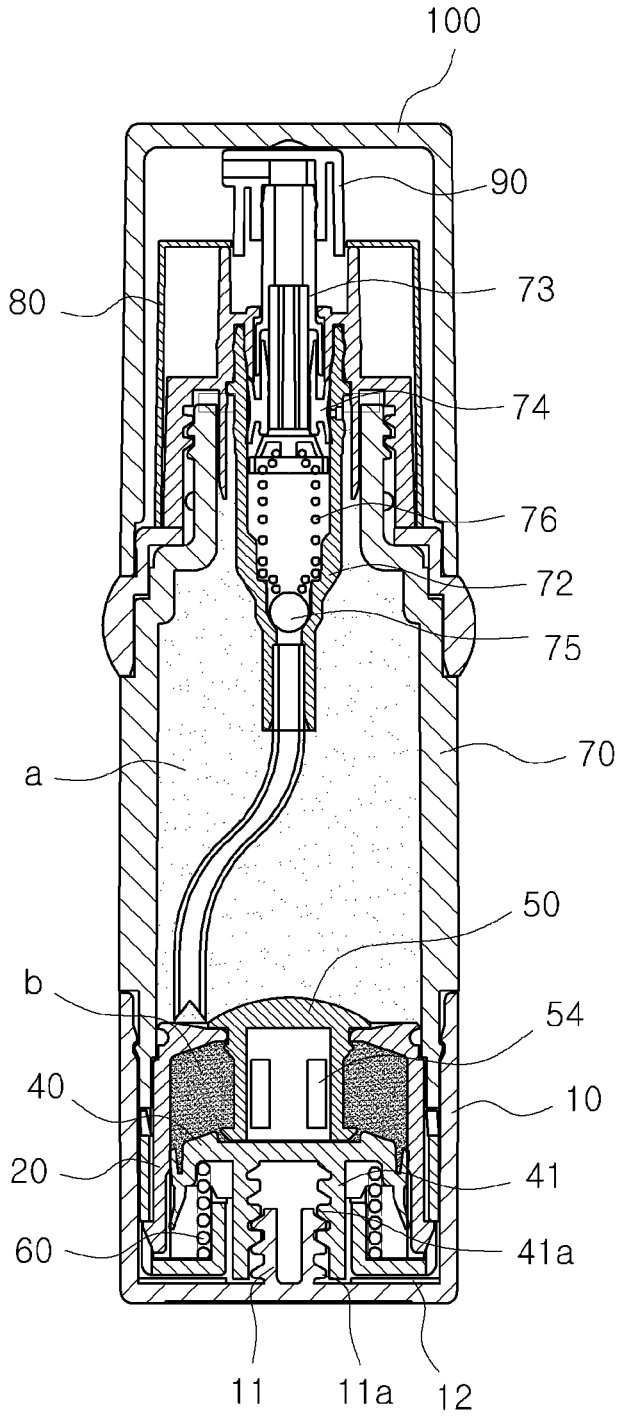
FIG. 9 is a sectional view illustrating an assembled state of the mixing container according to an embodiment of the present invention.

FIG. 9 is a sectional view illustrating an assembled state of the mixing container according to an embodiment of the present invention.

Figure 10:
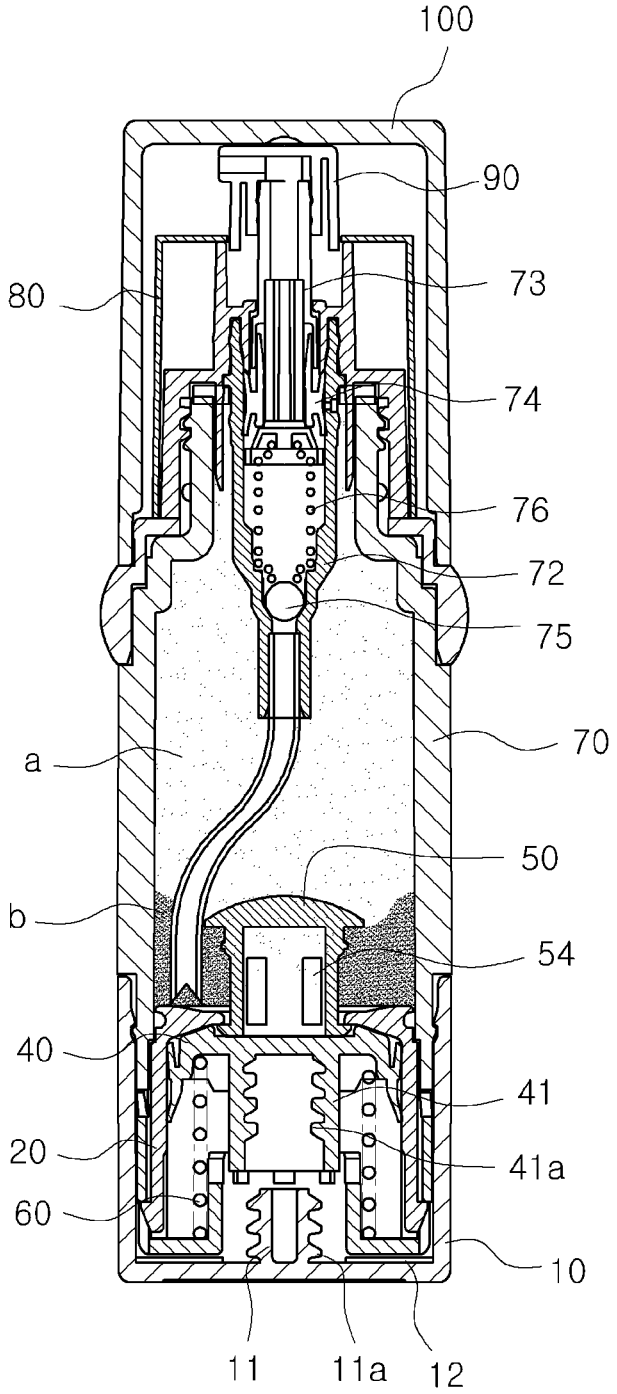
FIG. 10 is a sectional view illustrating operations of the mixing container according to an embodiment of the present invention in which a second liquid is mixed with a first liquid.

FIG. 10 is a sectional view illustrating operations of the mixing container according to an embodiment of the present invention in which a second liquid is mixed with a first liquid.

A mixing container according to an embodiment of the invention includes a rotating pushing member 10, a lower support 20, a liquid accommodating upper support 30, a vertical pushing member 40, an opening device 50, an elastic spring 60, a pumping unit 70, an upper case 80, a press button 90, and a cap 100.

The rotating pushing member 10 rotates clockwise and has a closed cylindrical lower side, a male screw 11 integrally formed on bottom center, and stoppers 12 installed at lateral upper sides of the bottom to determine rotation and stopping.

The lower support 20 has a cylindrical shape and inserted into and coupled with the rotating pushing member, and includes first saw teeth 21 formed on the upper side to block rotation, coupling recesses 22 formed in the lower side, and a plurality of protrusions 23 formed inside. The lower support 20 further includes a temporary stopper 24 to allow the stoppers 12 of the rotating pushing member 10 to move in a direction and an oblique tension 25 formed at a position spaced apart from the temporary stopper 24.

The liquid accommodating upper support 30 has a cylindrical shape with an opened lower side and is inserted into the lower support 20. To this end, the upper support 30 includes a plurality of coupling protrusions 31 formed on the lower outer side so that the upper support is coupled in the coupling recesses 22 of the lower support 20. The upper support 30 further includes a circular flange 32 formed on the upper side and having an opened center.

The vertical pushing member 40 is installed inside the lower support 20 and inside the rotating pushing member 10. The vertical pushing member 40 includes cylindrical female screw 41 formed at center to be coupled with the male screw 11 of the rotating pushing member 10. When the rotating pushing member 10 rotates clockwise, male threads 11*a* of the male screw 11 engage with female threads 41*a* of the cylindrical female screw 41 to push up a body. The vertical pushing member 40 further includes a plurality of guide protrusions 42 formed at the lower side to prevent idling and for easy ascending. The guide protrusions 42 slide and are coupled with the protrusions 23 of the lower support 20 to ascend.

The opening device 50 includes an opening disc 51 and a supporting unit 52. The supporting unit 52 is seated on the upper side of the vertical pushing member 40 and the opening disc 51 is seated on the circular flange 32 of the liquid accommodating upper support 30. When the vertical pushing member 40 ascends, the support 52 ascends and the opening disc 51 is separated from the circular flange 32 of the liquid accommodating upper support 30. In addition, the support 52 has bottom holes 53 and lateral holes 54 such that a second liquid b may move through the bottom holes 53 and the lateral holes 54 and may be mixed with a first liquid a.

The elastic spring 60 is installed between the lower support 20 and the vertical pushing member 40. The elastic spring 60 applies an elastic force to the vertical pushing member 40 up to the liquid accommodating upper support 30 when the rotating pushing member 10 rotates and the vertical pushing member 40 ascends to separate the opening device 50. By doing so, the liquid accommodated in the liquid accommodating upper support 30 is discharged up and mixed with the liquid accommodated in the container.

The pumping unit 70 includes second saw teeth 71 formed on the lower side thereof to be engaged with the first saw teeth 21 of the lower support 20 and a pumping device installed therein to pump a solution. That is, the pumping device may include a pumping cylinder 72, a pumping piston 73 installed at the upper side of the pumping cylinder 72 to transfer liquid solutions accommodated in a case to a chamber in the pumping cylinder 72 during lift up and down and discharge the same out, a sealing member 74 installed on the inner circumference of the pumping cylinder 72 to move in association with the lift up/down of the pumping piston and to seal the pumping cylinder or secure a passage such that the liquid solutions within the cylinder is discharged, and a check valve 75 installed at the inner lower side of the pumping cylinder 72 to suction the liquid solutions accommodated in the case into a pumping guide tube and to guide the liquid solutions accommodated in the pumping guide tube to be discharged out without retreat of the liquid cosmetics back into the case.

The press button 80 is installed at the upper side of the pumping unit 70 and the pumping unit 70 moves up and down due to the elastic spring 76 during vertical movement of the press button 80 to discharge the liquid solutions accommodated in the pumping unit.

The upper case 80 is encased by the pumping unit and the press button and is prevented from pollution caused by contact with the external.

The cap 100 closes all of the pumping unit 70, the upper case 80, and the press button 80 to protect principal devices from external shocks.

Hereinafter, the assembling process of the container according to the embodiment of the present invention will be described.

Since the container according to the embodiment of the present invention includes a rotating pushing unit 10, the lower support 20, the liquid accommodating upper support 30, the vertical pushing unit 40, the opening device, the elastic spring 60, the pumping unit 70, the upper case 80, the press button 90, and the cap 100, the lower support 20, the elastic spring 60, and the vertical pushing unit 40 are inserted into the rotating pushing unit 10.

The opening device 50 is mounted on the upper side of the vertical pushing unit 40 and the liquid accommodating upper support 30 encasing the vertical pushing unit 40 and the opening device 50 is inserted through a coupling hole formed in the inner circumference of the lower support 20.

In this case, the opening disc 51 of the opening device 50 is coupled to the circular flange 32 of the liquid accommodating upper support 30 and the pumping unit 70 is coupled with the upper side of the lower support 20. The lower support 20 and the pumping unit 70 are designed to be thread-coupled with each other to prevent easy separation.

The press button 90 is installed at the upper side of the pumping unit 70, the upper case 80 is installed outside the press button 90, and the cap 100 is coupled to the outside of the upper case 80 so that the assembling process of the container according to the embodiment of the present invention is completed.

The pumping unit 70 accommodates the first liquid a while the second liquid b is accommodated in the liquid accommodating upper support 30 and the opening disc 51 of the opening device 50 moves such that the vertical pushing unit 40 pushes the second liquid b up to be mixed with the first liquid a.

Hereinafter, operations of the container for mixing two different types of solutions according to the embodiment of the present invention will be described.

The container according to the embodiment of the present invention includes the rotating pushing unit 10, the lower support 20, the liquid accommodating upper support 30, the vertical pushing unit 40, the opening device 50, the elastic spring 60, the pumping unit 70, the upper case 80, the press button 90, and the cap 100. When the rotating pushing unit 10 is rotated clockwise, the vertical pushing unit 40 is pushed up. At this time, the opening device 50 that is installed at the upper side of the vertical pushing unit 40 is pushed up such that the opening disc 51 of the opening device 50 is separated from the liquid accommodating upper support 30 and the second liquid b accommodated in the liquid accommodating upper support 30 is mixed with the first liquid a accommodated in the pumping unit 70.

That is, since the first liquid a is accommodated in the pumping unit 70 and the second liquid b is accommodated in the liquid accommodating upper support 30, the second liquid b accommodated in the liquid accommodating upper support 30 flows toward the first liquid a accommodated in the pumping unit 70 so that the second liquid b is mixed with the first liquid a when the rotating pushing unit 10 is driven to lift the vertical pushing unit 40 up and to push the opening device 50 up.

Since the elastic spring 60 is installed between the lower support 20 and the vertical pushing unit 40, the opening device 50 is opened early. Then, due to the elastic force of the elastic spring 60, the vertical pushing unit 40 is lifted up and the opening device 50 is further lifted up so that the vertical pushing unit 40 pushes the second liquid b accommodated in the liquid accommodating upper support 30 up such that the second liquid b is easily mixed with the first liquid a.

Meanwhile, since the rotating pushing unit 10 includes the male screw 11 and the stopper 12 and the lower support 20 includes the temporary stopper 24 and the oblique tension 25 provided on the bottom inserted into the rotating pushing unit 10, the stopper 12 on the bottom of the rotating pushing unit 10 rotates while passing through the temporary pushing unit 10 and the male screw 11 moves to push the vertical pushing unit 40 up when the rotating pushing unit 10 rotates.

The stopper 12 passes through the oblique tension 25 and stops its rotation with making a sound 'click.' When the rotation of the rotating pushing unit 10 is stopped, the opening device 50 is opened and the vertical pushing unit 40 fully lifts the opening device 50 up with the elastic force of the elastic spring 60 such that the second liquid b flows through the bottom holes 53 and the lateral holes 54 of the supporting unit 52 and is completely mixed with the first liquid a.

The stopper 12 serves to rotate the rotating pushing unit 10 clockwise only. If a user intends to rotate the rotating pushing unit 10 counterclockwise, the rotating pushing unit 10 brings a contact with the oblique tension 25 and thus never rotates.

That is, the container according to the embodiment is designed such that the male screw 11 pushes the vertical pushing unit 40 up when the rotating pushing unit 10 rotates clockwise. This the rotating pushing unit 10 never rotates counterclockwise.

According to the container, the vertical pushing unit 40 should not be idle when the vertical pushing unit 40 is pushed up. In order to prevent this phenomenon, the lower support 20 is provided with the first saw teeth 21 formed on the upper edge thereof and the pumping unit is formed with the second saw teeth 71 corresponding to the first saw teeth 21 to be engaged with each other and to fix the lower support 20. The lower support 20 is provided with the protrusions 23 formed thereinside and the vertical pushing unit 40 is provided with the guide protrusions 42 formed thereinside such that the vertical pushing unit 40 moved up and down only along the protrusions 23 and the vertical pushing unit 40 is prevented from being idle.

That is, the container according to the embodiment is designed to transfer the rotation of the rotating pushing unit 10 into the lifting operation of the vertical pushing unit 40 without fail.

When the second liquid b is mixed with the first liquid a by the above-mentioned operations, a user shakes the container to mix the liquids completely and moves the press button 80 and the pumping unit 70 to discharge the mixed liquids out.

What is claimed is:

1. A container for mixing two different types of liquids comprising:

a rotating pushing unit rotating when gripped by fingers and having a male screw formed at the center thereof;

a cylindrical lower support inserted into the rotating pushing unit;

a liquid accommodating upper support inserted into the lower support and having an opened lower side and a flange formed at an upper side of the upper support;

a vertical pushing unit installed in the lower support and the rotating pushing unit and having a cylindrical shape with a closed upper side and a cylindrical female screw formed at the center thereof and engaged with the male screw of the rotating pushing unit such that the male screw is engaged with female threads of the cylindrical female screw to be lifted up when the rotating pushing unit rotates clockwise;

an opening device including an opening disc, a supporting unit seated on the vertical pushing unit, and bottom holes and lateral holes formed in the supporting unit, the opening disc being seated on a circular flange of the liquid accommodating upper support;

an elastic spring installed between the lower support and the vertical pushing unit and rotating the rotating pushing unit to ascend and applying an elastic force to the vertical pushing unit up to the liquid accommodating upper support when the opening device is released such that a liquid accommodated in the liquid accommodating upper support is discharge out to the upper side and is mixed with another liquid in the container;

a pumping unit installed on the lower support and accommodating a liquid to pump the mixed liquid out when the liquid accommodated in the liquid accommodating upper support is mixed; and a press button installed on the pumping unit to operate the pumping unit to discharge the mixed liquid in the pumping unit out.

2. The container of claim 1, wherein the lower support includes first saw teeth formed at the upper side and the pumping unit includes second saw teeth corresponding to the first saw teeth to be engaged with each other.

3. The container of claim 1, wherein the rotating pushing unit comprises a stopper formed at a bottom of the pushing unit to determine rotation and stopping, and the lower support comprises a temporary stopper moving the stopper of the rotating pushing unit in a direction and an oblique tension formed at a position spaced apart from the temporary stopper.

4. The container of claim 1, wherein the lower support is formed with coupling recesses at the lower side of the liquid accommodating upper support is formed with a plurality of coupling protrusions at the lower outer side thereof to correspond to the coupling recesses such that the coupling protrusions are engaged with the coupling recesses of the lower support.

5. The container of claim 1, wherein the lower support is formed with a plurality of protrusions therein and the vertical pushing unit is formed with a plurality of guide protrusions corresponding to the protrusions of the lower support such that the guide protrusions slide on the protrusions of the lower support to be lifted up.

6. The container of claim 1, wherein the pumping unit comprises:

a pumping cylinder;

a pumping piston installed on the pumping cylinder to move a cosmetic liquid accommodated in a case due to vertical movement to a chamber of the pumping cylinder to discharge the cosmetic liquid out;

a sealing member installed on the inner circumference of the pumping cylinder and moved by the vertical movement of the pumping piston to close the inside of the pumping cylinder and secure a passage such that the liquid solution in the cylinder is discharged out; and a check valve installed at an inner lower side of the pumping cylinder to suction the liquid solutions accommodated in the case into a pumping guide tube and to guide the liquid solutions accommodated in the pumping guide tube to be discharged out without retreat of liquid cosmetics back into the case.

* * * * *